United States Patent [19]

Nakamura

[11] Patent Number: 5,024,197

[45] Date of Patent: Jun. 18, 1991

[54] ENGINE IDLING CONTROL APPARATUS

[75] Inventor: Akihisa Nakamura, Tokyo, Japan

[73] Assignee: Fuji Jukogyo Kabshiki Kaisha, Tokyo, Japan

[21] Appl. No.: 515,084

[22] Filed: Apr. 26, 1990

[30] Foreign Application Priority Data

Apr. 28, 1989 [JP] Japan ..... 1-110563
Apr. 28, 1989 [JP] Japan ..... 1-110564

[51] Int. Cl.[5] ..... F02D 41/08; F02D 41/16
[52] U.S. Cl. ..... 123/339; 364/431.07
[58] Field of Search ..... 123/339, 494; 73/116, 73/117.3, 119 R; 364/431.01, 431.03, 431.07, 431.12

[56] References Cited

U.S. PATENT DOCUMENTS 4,705,001 11/1987 Danno et al. ..... 123/339 X
4,708,108 11/1987 Sakamoto et al. ..... 123/339
4,729,359 3/1988 Tomisawa et al. ..... 123/339 X
4,747,379 5/1988 Oba ..... 123/339
4,827,885 5/1989 Nishikawa et al. ..... 123/339
4,864,997 9/1989 Miyachi ..... 123/339 X
4,883,034 11/1989 Yashiki et al. ..... 123/339

*Primary Examiner*—Willis R. Wolfe

*Attorney, Agent, or Firm*—Beveridge, DeGrandi & Weilacher

[57] ABSTRACT

An engine idling control apparatus, which has a throttle position sensor for detecting an opening degree of the throttle valve, and an idle switch for changing a state thereof at a predetermined throttle opening degree near a fully closed state of the throttle valve, comprises; a circuit for judging the state of the idle switch responsive to output from the idle switch; a circuit for updating a minimum value of output values from the throttle position sensor; a circuit for updating an increase compensation value to increase when the idle switch state judging circuit judges closed state of the idle switch, and for updating the increase compensation value to initialize when the idle switch state judging circuit judges open state of the idle switch; a circuit for setting a reference value to judge an idling state by adding the increase compensation value from the increase compensation value updating circuit and a predetermined offset value to the minimum value from the minimum value updating circuit; and a circuit for judging the idling state by comparing the reference value which is set by the reference value setting circuit with the output value from the throttle position sensor.

4 Claims, 10 Drawing Sheets

THROTTLE VALVE OPEN
IDLING JUDGING SIGNAL
VALVE CLOSED
IDLING SIGNAL (SOFT IDLE)
ON
OFF
THV
THV
THV

ENGINE IDLING CONTROL APPARATUS

BACKGROUND OF THE INVENTION

The present invention relates to an engine idling control apparatus which is capable of precisely judging an engine idling state from an output signal of a throttle sensor.

During an idling operation of an engine, an engine speed is set to a predetermined value by regulating an intake air quantity flowing through a bypass for bypassing a throttle valve in dependency on a control of an idle speed control valve (ISCV). Ignition timings are set to a preset crank angle.

Conventionally, the engine idling state has been mechanically judged by an idling switch in dependency on operation of the throttle valve. If the switch is turned on, it is unconditionally judged that the throttle valve is fully closed, i.e., in the idling state, and the engine idling operation starts.

In practice, however, since it is necessary to turn on the idle switch definitely when the throttle valve is fully closed, the idle switch is arranged to turn on at a predetermined opening degree before the throttle valve is fully closed.

As the result., if an acceleration pedal is depressed to start a vehicle, although the engine speed rises, the idling control does not terminate until the throttle valve is opened over the predetermined opening degree. Furthermore, if the vehicle is decelerating, the idle switch is turned on and idling control starts in an incomplete state even though the throttle valve still opens.

In the case of a conventional engine, since an area change ratio of the throttle bore between the predetermined opening degree at which the idle switch turns on or off and a fully closed state of the throttle valve is small, that is, a changing range of intake air quantity is small, the start, the acceleration and the deceleration performance are not influenced largely by the operation of the idling switch mentioned above.

However, a latest engine has a throttle bore with a large diameter so as to obtain a high performance and a high output power. Even a small change in an opening degree of the throttle valve will therefore result in a large change in the intake air quantity. Accordingly, when idling control is performed or ended in response to a signal output from the idle switch, the engine outputs an insufficient power. As a result, not only the start, the acceleration and the deceleration performance are degraded, but also where the exhaust gas emission and fuel consumption are deteriorated. Furthermore, controllability of idling operation is also more difficult.

In order to deal with .the above problem, it can be considered that the idle switch may be set near a fully closed position of the throttle valve so as to ensure proper ON/OFF operation. However, the distance between the switching contacts is limited, and setting such a distance is difficult in practice, making this arrangement unsuitable for mass production and hard to realize.

Apart from the above, an idling control system is disclosed in Japanese Patent Publication No. 63-15467 (1988). In the system, the minimum opening degree of the throttle valve is stored in a memory, and a stored value is updated in accordance with an output value from a throttle sensor when the value becomes smaller than the minimum value. At the same time, idling control is performed in dependency on the judgement of the fully closed state of the throttle valve (the idling state) when the output value of the throttle sensor is within a dead zone against the stored value.

The prior art, however, only updates the stored value in dependency on the value output from the throttle sensor when the value of the sensor becomes smaller than the stored value, so that the stored value is updated to be only in the smaller side. Furthermore, the sensor output value becomes higher than the dead zone of the reference value even though the throttle valve is fully closed, when an amount of the sensor output value drifts at the fully closed state of the throttle valve in dependency on such influences as the distortion of a throttle shaft due to connecting a potentiometer as the throttle sensor, strain by negative pressure at the fully closed state, or a temperature change. Therefore, the system of the prior art becomes not to detect the fully closed state of the throttle valve.

Accordingly, we have proposed the following technique, as shown in FIG. 7. A reference value THVISW is set by adding an off-set value $\alpha$ to a minimum stored value $THV_{MIN}$ of an output value THV of the throttle sensor. When the idle switch is turned on and when the output value THV of the throttle sensor is over the reference value $THV_{ISW}(=THV_{MIN}+\alpha)$ (lapsed times t4b to t4a), the reference value $THV_{ISW}$ is corrected in the manner whereby the value $THV_{ISW}$ is increased by increasing the minimum value $THV_{MIN}$ in the throttle opening direction by a predetermined value at every predetermined time TIME. As a result, the reference value $THV_{ISW}$ becomes higher than the output value THV (at t4a), so that the idling state is detected (from t4a to t5).

However, as described above, a driver of the vehicle having the engine with large throttle has much time to lightly depress an accelerator pedal to maintain a very small opening degree of the throttle valve at the constant-speed driving on a straight road. This is because such an engine generates a strong power by a small change of the throttle valve opening.

Accordingly, the output value THV of the throttle sensor becomes $THV > THV_{ISW}$ when the accelerator pedal is lightly depressed, as shown by lapsed times t5 and t6 in FIG. 7. Then, if the mechanical idling switch maintains 0N state, the minimum stored value $THV_{MIN}$ is updated by a predetermined value at every predetermined time TIME until reference value $THV_{ISW}$ becomes over the output value THV of the throttle sensor (to the lapsed time t5a). After that, if the idling switch is turned off further by depressing the pedal (at the lapsed time t6), the minimum stored value $THV_{MIN}$ is maintained at a present value until the idling state is detected again according to THVISW and THV (a lapsed time t7).

The idling state is determined earlier than a preferable timing during closing the throttle valve (lapsed times t7 and t8) because the reference value $THV_{ISW}$ set by the minimum stored value $THV_{MIN}$ is raised to a higher value. As a result, the conventional apparatus has the problems of deteriorating controllability of an air-fuel ratio, an ignition timing at the begining of coasting drive, thereby making it more difficult to drive the vehicle.

SUMMARY OF THE INVENTION

An object of the present invention is to provide an engine idling control apparatus capable of improving the controllability of the air-fuel ratio and an ignition timing of an engine and a drivability of the vehicle in the manner that an idling state is determined to be precisely detected without wrong judgement, a stable power performance of the engine can be obtained by avoiding early idling control even if the idle switch mechanically turns on during steady driving, and the idling state is judged as incomplete even at a begining of a coasting driving of the vehicle.

An engine idling control apparatus according to the present invention, having a throttle position sensor for detecting an opening degree of the throttle valve and an idle switch for changing state thereof at a predetermined throttle opening degree near a fully closed state of the throttle valve, comprises a circuit for judging the state of the idle switch responsive to output from the idle switch; a circuit for updating a minimum value of output values from the throttle sensor; a circuit for updating an increase compensation value to increase when the idle switch state judging circuit judges closed state of the idle switch, and for updating the increase compensation value to initialize when the idle switch state judging circuit judges open state of the idle switch; a circuit for setting a reference value to judge an idling state by adding the increase compensation value from the increase compensation value updating circuit and a predetermined offset value to the minimum value from the minimum value updating circuit; and a circuit for judging the idling state by comparing the reference value which is set by the reference value setting circuit with the output value from the throttle position sensor.

Furthermore, the apparatus of the present invention may comprise a circuit for judging an upper limit of the increase compensation value when the increase compensation value resides more than a preset upper limit value, so as to fix the increase compensation value to the preset upper limit value.

With the engine idling control apparatus constructed as described above, the output value of the throttle sensor is compared with the minimum value. The minimum value is updated by the output value when the output value is smaller than the minimum value.

The increase compensation value is increased when the idle switch is closed. On the other hand, the increase compensation value is initialized when the idle switch is opened.

The reference value is set by adding the increase compensation value and the predetermined offset value with the minimum value, thereby judging the idling state by comparing the reference value with the output value of the throttle sensor.

Furthermore, when the increase compensation value limit judging circuit is comprised at a request, the increase compensation value is compared with the preset upper limit value. The increase compensation value is fixed to the upper limit value when the increase compensation value reaches the upper limit value.

DETAILED DESCRIPTION OF THE PREFERRED EMBODIMENTS

Figure 1:
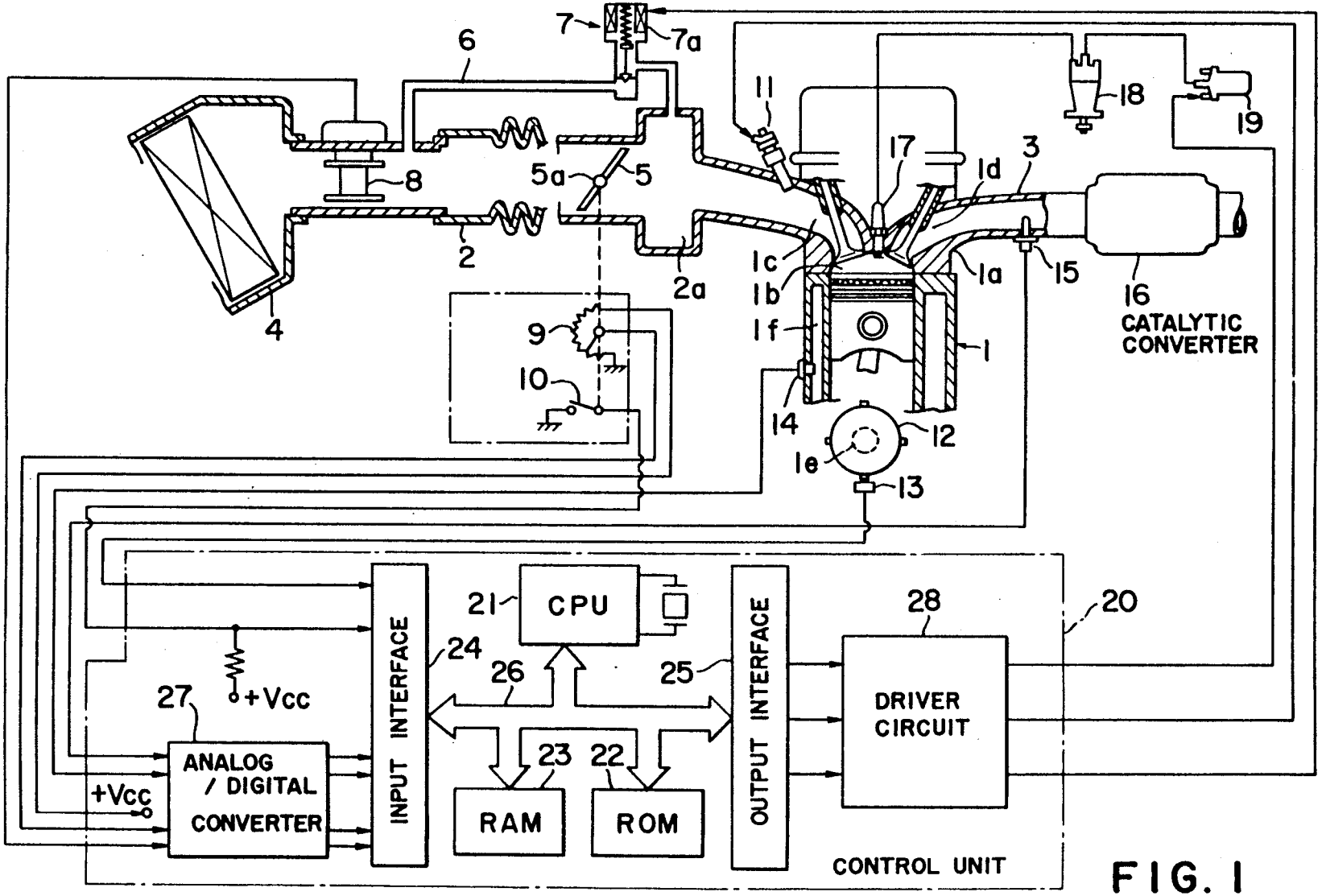
FIG. 1 is a schematic view of an engine control system.

There will now be described in detail preferred embodiments with reference to the accompanying drawings. An entire engine system of an idling control apparatus according to the present invention is described.

In the figure, an engine 1 has a cylinder head 1*a*, a combustion chamber 1*b*, an intake air port 1*c*, and an exhaust air port 1*d* respectively opened to the chamber 1*b*. An intake pipe 2 communicates to the intake port 1*b*, while an air exhaust pipe 3 communicates to the exhaust port 1*c*. An air cleaner 4 is mounted at the upstream position of the pipe 2. A throttle valve 5 is also mounted at the midst of the pipe 2, and an air chamber 2*a* is formed at the immediately downstream position of the throttle valve 5.

An air bypass 6 communicates with the intake pipe 2, bypassing the throttle valve 5. An idle speed control valve (ISCV) 7 is mounted in the air bypass 6.

An intake air quantity sensor (a hot wire type air flow meter is shown in the figure) 8 is mounted within the intake pipe 2 at the immediately downstream part of the cleaner 4.

A throttle position sensor 9 and an idle switch 10 are mounted on a throttle shaft 5*a* of the throttle valve 5 in cooperative relation to each other. The idle switch 10 is set to ensure a certain operation thereof in the manner that the switch 10 is turned on or off at a predetermined opening degree $\theta$·where the valve 5 is slightly opened from the fully closed state thereof.

Furthermore, an injector 11 is mounted on the intake pipe 2 at the immediately upstream position of the port 1*c*.

The engine 1 has a crank shaft le on which a crank rotor 12 is mounted. The rotor 12 has a plurality of projections or slits at every predetermined degrees of the crank angle on an external surface thereof. A crank angle sensor 13 such as an electromagnetic pickup is provided at a point around the rotor 12 in order to detect the crank angle. A coolant temperature sensor 14 is exposed in a coolant passage 1f of the engine 1. An oxygen ($0_2$) sensor 15 is exposed in the exhaust pipe 3, and a catalytic converter 16 is provided at a downstream part of the pipe 3.

On the other hand, reference numeral 20 denotes a control unit such as a microcomputer. The unit 20 comprises a central processing unit (CPU) 21, a read only memory (ROM) 22, a random access memory (RAM) 23, an input interface 24, and an output interface 25, which are interconnected by a bus line 26. The unit 20 further comprises an analog/ digital (A/D) converter 27 and a driver circuit 28.

The idle switch 10 and the crank angle sensor 13 are connected to the input interface 24, and the intake air quantity sensor 8, the throttle sensor 9, the coolant temperature sensor 14 and the oxygen sensor 15 are connected to the input interface 24 through the A/D converter 27.

The injector 11 and a coil 7a of the ISCV 7 are respectively connected to the output interface 25 through the driver circuit 28. A spark plug 17 is connected to the output interface 25 through a distributor 18, an igniter 19 and the driver circuit 28.

The ROM 22 stores fixed data and control programs, and the RAM 23 stores data after processing signals input to the interface 24 in the CPU 21. The CPU 21 controls an air-fuel ratio, ignition timing and engine speed at an idling state in dependency on various data stored in the RAM 23 according to the control programs stored in the ROM 22.

Figure 2:
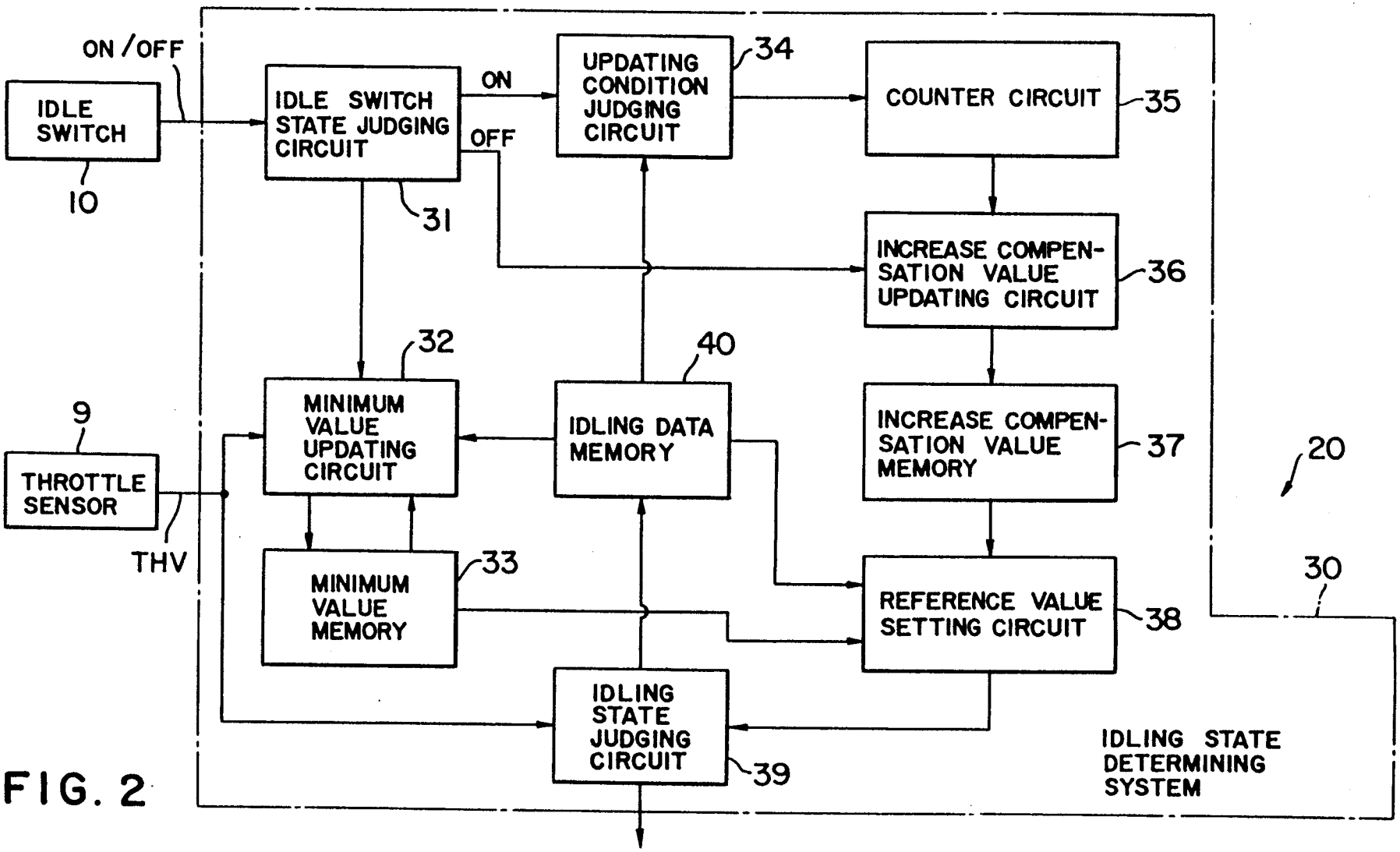
FIG. 2 is a block diagram showing an engine idling control apparatus according to a first embodiment of the present invention.

As shown in FIG. 2, the control unit 20 comprises an idling state determining system 30 for determining the idling state. The system 30 comprises an idle switch state judging circuit 31, a minimum value updating circuit 32, a minimum value memory 33, an increase compensation value updating condition judging circuit 34, a counter circuit 35, an increase compensation value updating circuit 36, an increase compensation value memory 37, a reference value setting circuit 38, an idling state judging circuit 39 and an idling data memory 40.

The circuit 31 judges whether the engine is in a mechanical idling state in accordance with a signal output from the idle switch 10 or not. Namely, the mechanical idling state is determined when the switch 10 is turned on, while a non-idling state is determined when the switch 10 is turned off. The circuit 31 outputs a trigger signal when the mechanical idling state is determined at the switch 10 being turned on. The switch 10 is turned off when the throttle valve opening degree $\theta$ is over the predetermined degree $\theta\cdot$, and turned on when under the predetermined degree $\theta\cdot$. At assembling, the switch 10 is set in the manner of turning on or off at the position where the valve 5 slightly opens for ensuring ON/OFF operation and eliminating a detection error.

The circuit 32 reads an output value (voltage) THV corresponding to the opening degree $\theta$ of the throttle sensor 9 and idling data $AI_{DATA}$ stored in the memory 40 when receives the trigger signal output from the circuit 31. The circuit 32 compares the value THV with a minimum value $THV_{MIN}$ corresponding to a minimum opening degree $\theta_{MIN}$ stored in the minimum value memory 33 constructed by predetermined regions of the RAM 23 only when the data $AI_{DATA}$ is equal to $\phi$ (the engine is in the idling state), thereby updating the stored minimum value $THV_{MIN}$ by the value THV when the value THV is under the minimum value $THV_{MIN}$.

The circuit 34 reads the judged result of judging circuit 31 and the idling data $AI_{DATA}$ stored in the idling data memory 40 which is constructed by other regions different to the circuit 33 in the RAM 23. The circuit 34 judges that the updating condition for an increase compensation value is completed when the idling switch 10 is turned on and when the idling data $AI_{DATA}$ is "1" (the engine is the non-idling state), thereby outputting the trigger signal to the counter circuit 35.

The counter circuit 35 starts counting in response to the trigger signal from the judging circuit 34, and outputs the trigger signal to the updating circuit 36 when the updating condition is kept during a predetermined time interval TIME such as one second (TIME=1 sec).

The updating circuit 36 updates an increase compensation value $THV_D$ by adding a set value $THV_S$ (for example, 1bit;5mv) to the value $THV_D$ stored in the memory 37 which is constructed by a predetermined address region of the RAM 23, in response to every trigger signal from the counter circuit 35 ($THV_D \leftarrow THV_D + THV_S$).

Furthermore, the updating circuit 36 clarifies the value $THV_D$ stored in the memory 37 ($THV_D \leftarrow \phi$) when the circuit 31 judges that the engine changes from the mechanical idling state, that is, the idle switch 10 is turned off.

The setting circuit 38 reads the minimum value $THV_{MIN}$, the idling data $AI_{DATA}$, and the increase compensation value $THV_D$, which are stored in the memories 33, 37 and 40, respectively. The circuit 38 adds a first offset value A (for example, 2 or 3 bits ; 10 to 15 mv) and the compensation value $THV_D$ to the minimum value $THV_{MIN}$ when the engine is out of the idling state ($AI_{DATA}=1$), thereby setting the additional value as the reference value $THV_{ISW}$ ($THV_{ISW} \leftarrow THV_{MIN} + A + THV_D$).

On the other hand, the circuit 38 adds first and second off-set values A and B (for example, 1 or 2 bits ; 5 to 10 mv)and the compensation value $THV_D$ to the minimum value $THV_{MIN}$ when the engine is in the idling state ($AI_{DATA}=0$), thereby setting the additional value as the reference value $THV_{ISW}$($THV_{ISW} \leftarrow THV_{MIN} + A + B + THV_D$).

The judging circuit 39 reads the reference value $THV_{ISW}$ set by the setting circuit 38 and compares the value $THV_{ISW}$ with the output value THV of the throttle sensor 9. The circuit 39 causes the memory 40 to store the idling data $AI_{DATA}$ as "$AI_{DATA}=0$" and outputs an idling state signal representing the idling state of the engine when "$THV \leqq THV_{ISW}$". On the contrary, when the state is in "$THV > THV_{ISW}$", the circuit 39 determines the engine 1 is out of the idling state and makes the memory 40 store the idling data $AI_{DATA}$ as "$AI_{DATA}=1$", so as to output a non-idling state signal.

Figure 3A:
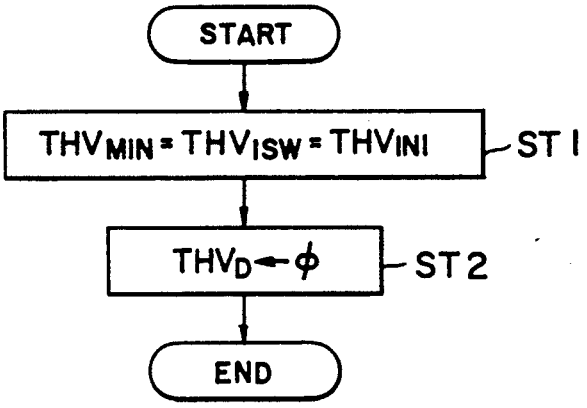
FIGS. 3A and 3B are flow charts respectively showing updating procedures for a stored minimum value and an increase compensation value of the apparatus according to the first embodiment.
Figure 3B:
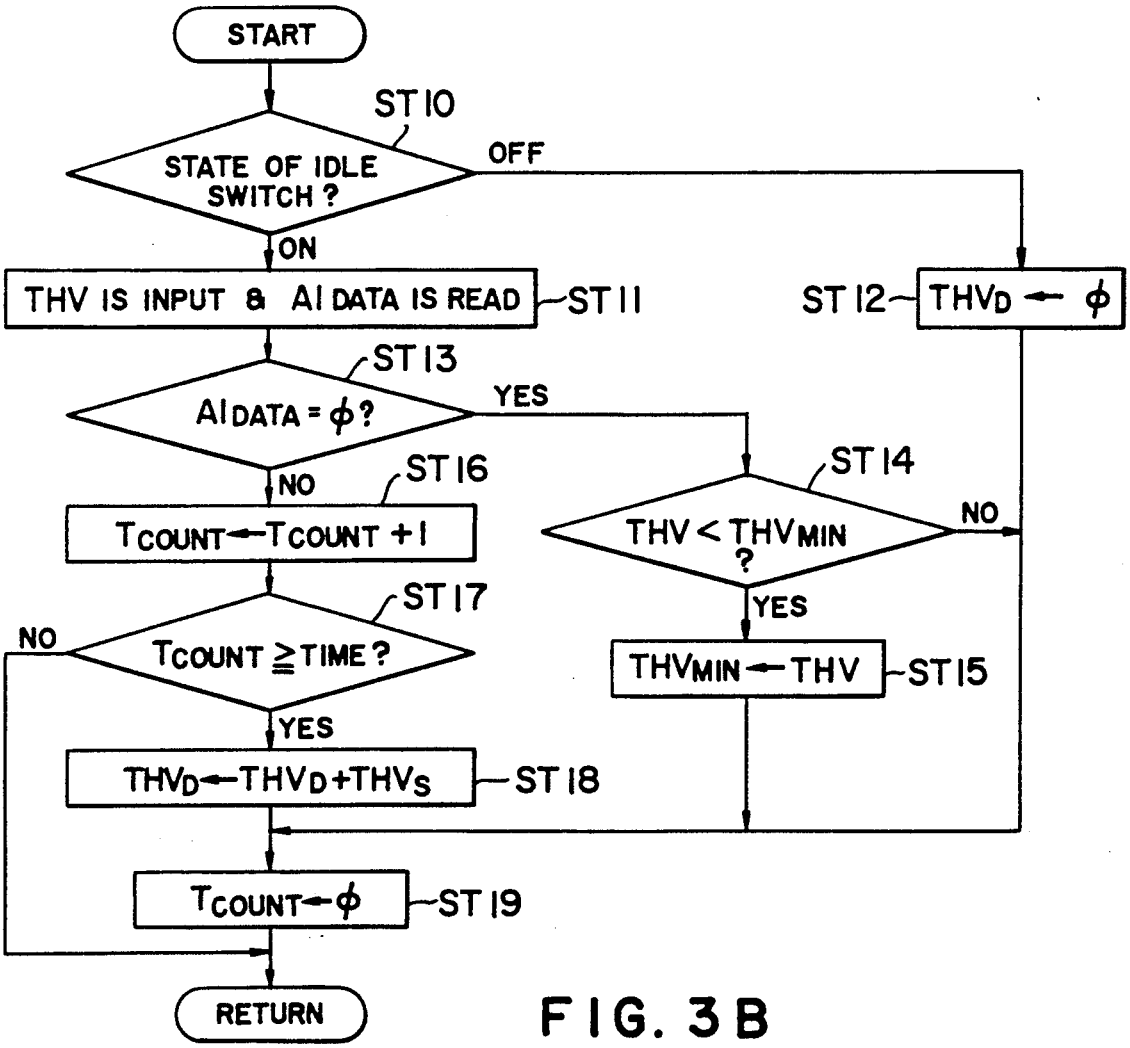
Figure 4:
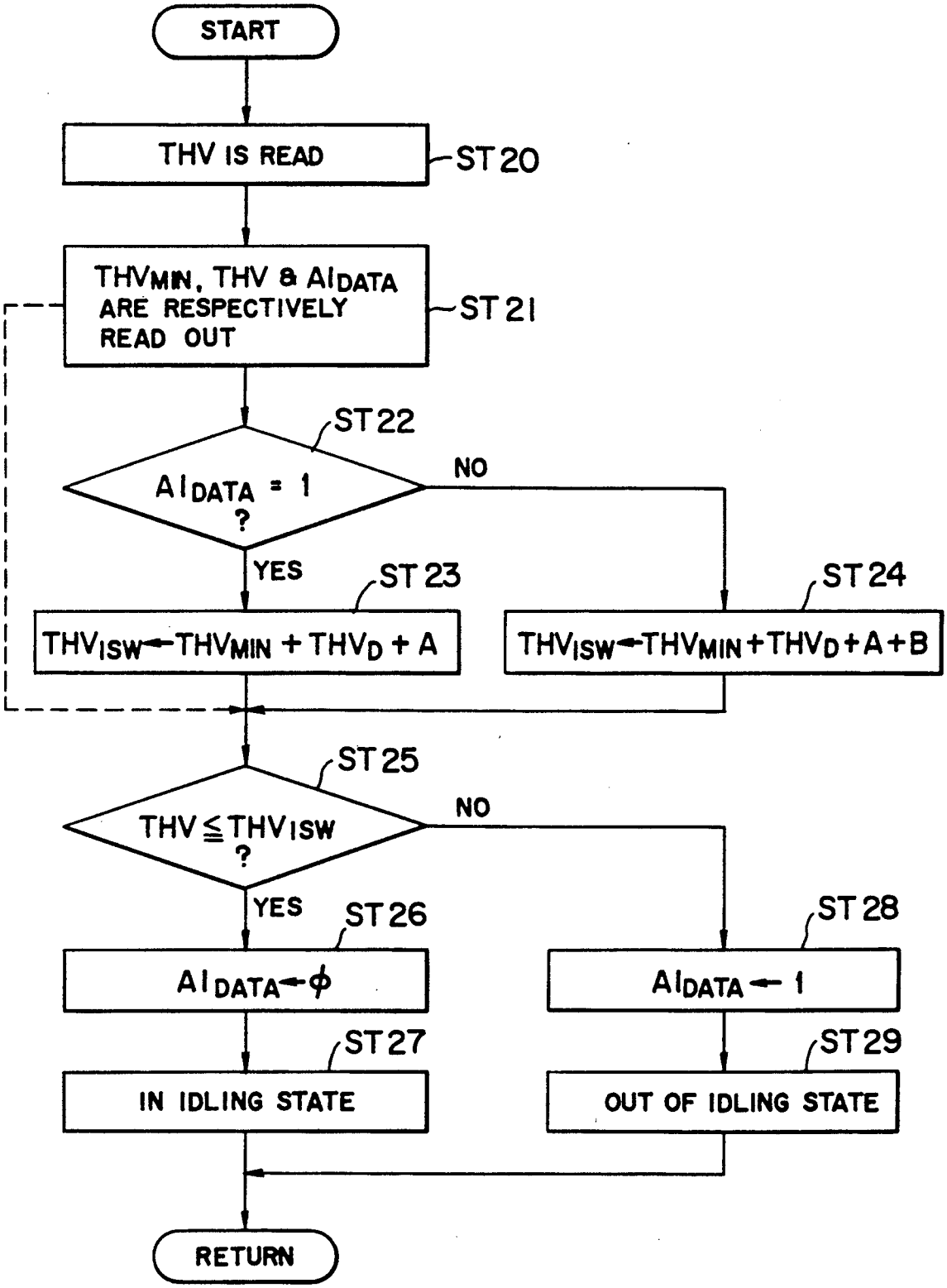
FIG. 4 is a flow chart showing a procedure for judging an idling state according to the first embodiment of the present invention.

Next, operation of the system 30 having the above-mentioned functional construction will now be described with reference to flow charts as shown in FIGS. 3A, 3B and 4.

First, as shown in FIG. 3A, a main routine starts after a power source of the control unit 20 is turned on when the ignition switch is turned on. In a step ST1, the minimum value $THV_{MIN}$ and the reference value $THV_{ISW}$ respectively stored in the predetermined address regions of the RAM 23 are initialized by an initial value $THV_{INI}$ obtained in accordance with an experiment ($THV_{MIN}=THV_{ISW}=THV_{INI}$) immediately after turning on the power. In a step ST2, the increase compensation value $THV_D$ is set to $\phi$($THV_D=\phi$).

When assembling the throttle sensor 9 to the engine 1, the output value THV of the throttle sensor 9 at the fully closed state the throttle valve and the value THV corresponding to a changing point of the idle switch 10 are detected, so that a mean value between both values THV is set as the initial value $THV_{INI}$.

Frequently, the throttle valve 9 is not fully closed at turning on the power, so that the value THV of the sensor 9 at the fully closed state of the throttle valve is not obtained. Furthermore, the value THV changes as characteristics of the sensor 9 change with the lapse of time. Accordingly, a first value of the reference value $THV_{ISW}$ and the minimum value $THV_{MIN}$ is clarified by using the initial value $THV_{INI}$ at inialization.

Next, the minimum value $THV_{MIN}$ and the increase compensation value $THV_D$ are updated according to a program as shown in FIG. 3B. The value $THV_{MIN}$ is a standard value upon the setting of the reference value $THV_{ISW}$ used in an idling determination.

First in a step ST10, the idle switch 10 is judged to be turned on or off. Operation continues to a step ST11 when ON state of the idle switch 10 is mechanically detected, and to a step ST12 when the switch 10 is in OFF state. In the step ST12, the increase compensation value $THV_D$ stored in the predetermined address of the RAM 23 is set to $\phi(THV_D \leftarrow \phi)$, so that the operation advances to a step ST19.

For example, when the engine starts in the condition of an accelerator pedal being released, the operation advances to the step STII because the idle switch 10 is in the 0N state.

On the other hand, when the engine starts by depressing the accelerator pedal, operation advances to the step ST19 through the step ST12 because the idle switch 10 is in the OFF state, so that the minimum value $THV_{MIN}$ is not updated.

In the step STII, an idling data $AI_{DATA}$ is read from another address region of the RAM 23, and the output value of the throttle sensor 9 is read out. Operation advances to a step ST13.

The idling data $AI_{DATA}$ represents a judging result of the idling state in the judging circuit 39 and are set in steps ST26 or ST28 of FIG. 4 showing an idling state judging procedure. In the step ST13, when the data $AI_{DATA}$ is zero ($AI_{DATA}=0$), the circuit 39 judges the engine to be in the idling state, while the engine is judged to be out of the idling state when $AI_{DATA}=1$. Operation advances to a step ST14 at "$AI_{DATA}=0$", but to a step ST16 at "$AI_{DATA}=1$".

In a first routine of the program, operation may be programmed to jump the step ST13 to advance to the step ST14 because the idling data $AI_{DATA}$ is not set (not shown). As described above, in second and later routines, the processing advances from the step ST13 to the step ST14 or the step ST16.

In the step ST14, the output value THV of the sensor 9 read in the step STII is compared with the minimum value $THV_{MIN}$ stored in the RAM 23. When "$THV \geqq THV_{MIN}$", operation advances to a step ST19, and to a step ST15 when "$THV < THV_{MIN}$".

When the engine starts with the release of the pedal, the output value THV of the sensor 9 read in step STII is the minimum value because of the throttle valve fully closed, and the value THV is lower than the initial set minimum value $THV_{MIN}$ set in the step ST11, so as to advance to a step ST15. In the step ST15, the minimum value $THV_{MIN}$ stored in the RAM 23 is updated by the value THV read in the step ST11 ($THV_{MIN} \leftarrow THV$). In the step ST19, the counted value $T_{COUNT}$ is clarified ($T_{COUNT} \leftarrow \phi$), to therefore end the program (a lapse time t1 in FIG. 5).

At this time, the idling judging procedure shown in FIG. 4 has a step ST20 where the value THV of the sensor 9 is read out, and a step ST21 where the minimum value $THV_{MIN}$ stored in the RAM 23, the increase compensation value $THV_D$ and the idling data $AI_{DATA}$ are read out, to therefore advance to a step ST22.

In the step ST22 shown in FIG. 4, the idling data $AI_{DATA}$ is determined whether or not $AI_{DATA}=1$. At the first time of routine, operation may jump from the step ST21 to the step ST25 because the data $AI_{DATA}$ has not been recognized yet (not shown).

In the step ST25, the value THV of the sensor 9 read in the step ST20 is compared with the reference value $THV_{ISW}$ A first reference value $THV_{ISW}$ is set to the initial value in the step ST1 of FIG. 3A ($THV_{ISW}=THV_{INI}$) The engine is determined to be in the idling state because the output value THV is on or lower than the reference value THVISW ($=THV_{INI}$), namely "$THV \leqq THV_{ISW}$", therefore advancing to a step ST26.

Figure 5:
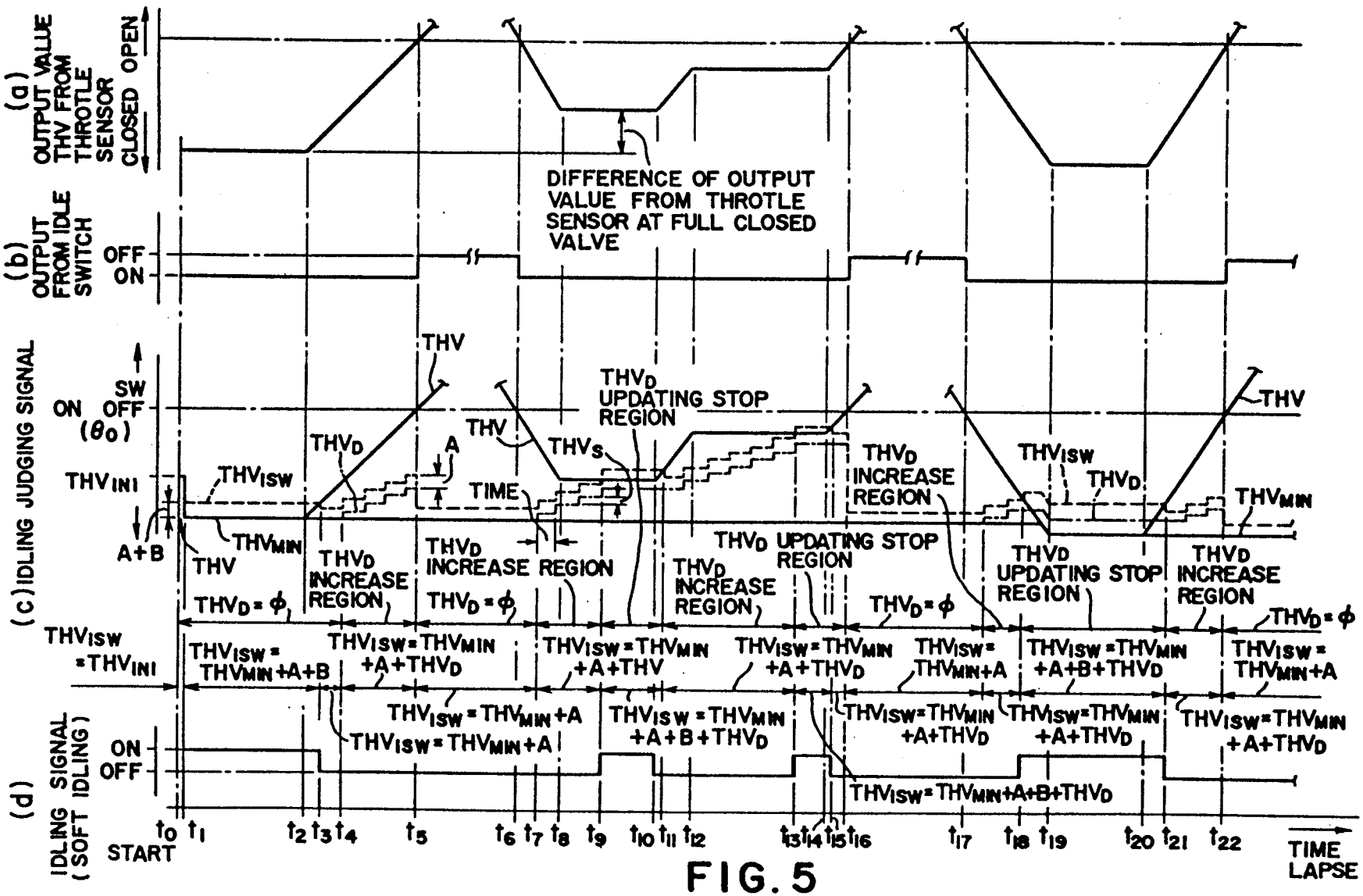
FIG. 5 is a timing chart showing (a) an output value from a throttle sensor, (b) an idle switch output, (c) an idling judging signal, and (d) a soft idling state, respectively.

In step ST26, the idling data $AI_{DATA}$ is set to "$AI_{DATA}=0$" to be stored in the predetermined address of the RAM 23. To then advance in step ST27, the idling state signal is output (lapsed times t0 and t1 as shown in FIG. 5).

Figure 6:
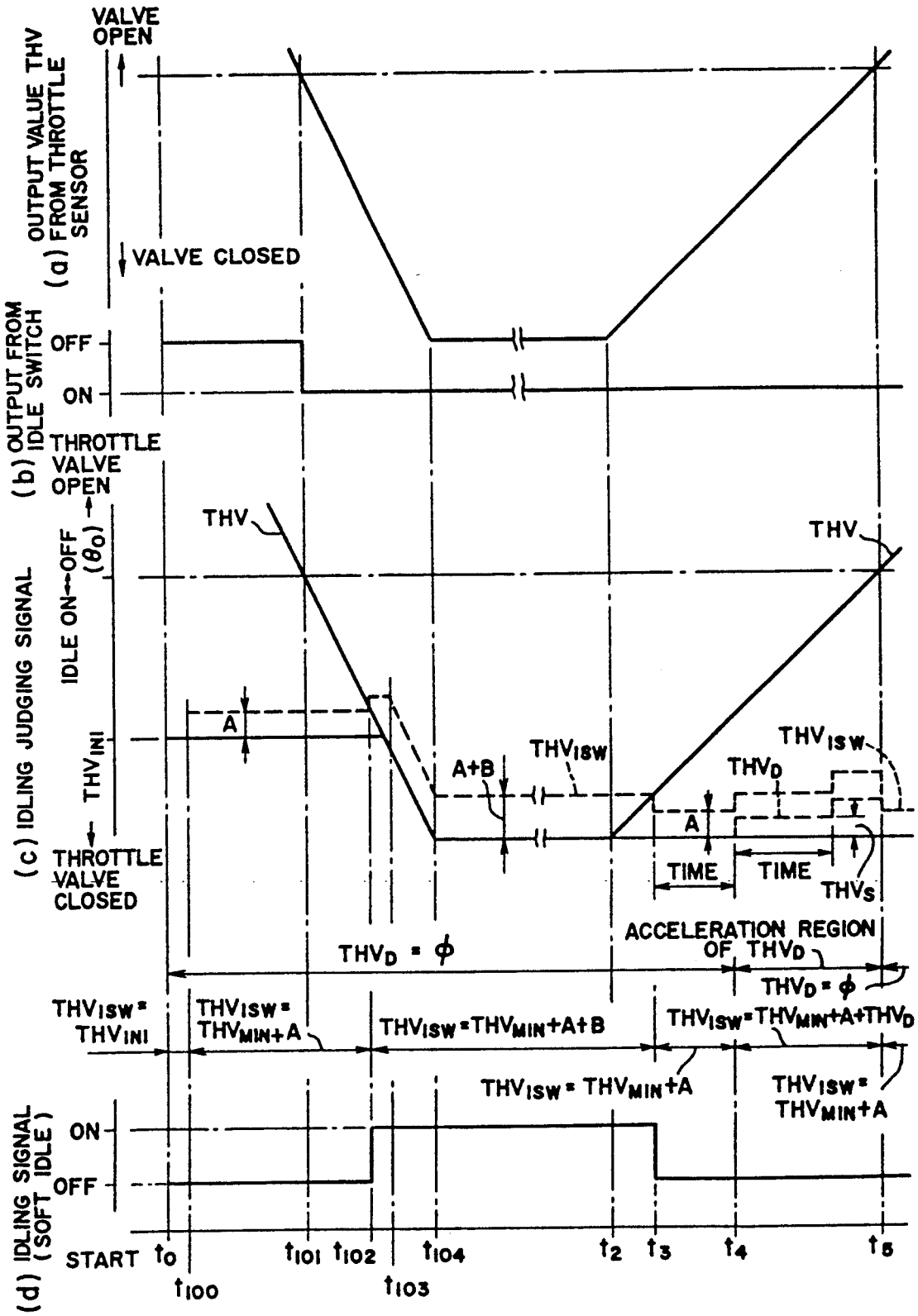
FIG. 6 is a timing chart showing a case of starting an engine by depressing an accelerator pedal in the control apparatus accOrding to the first embodiment.
Figure 7:
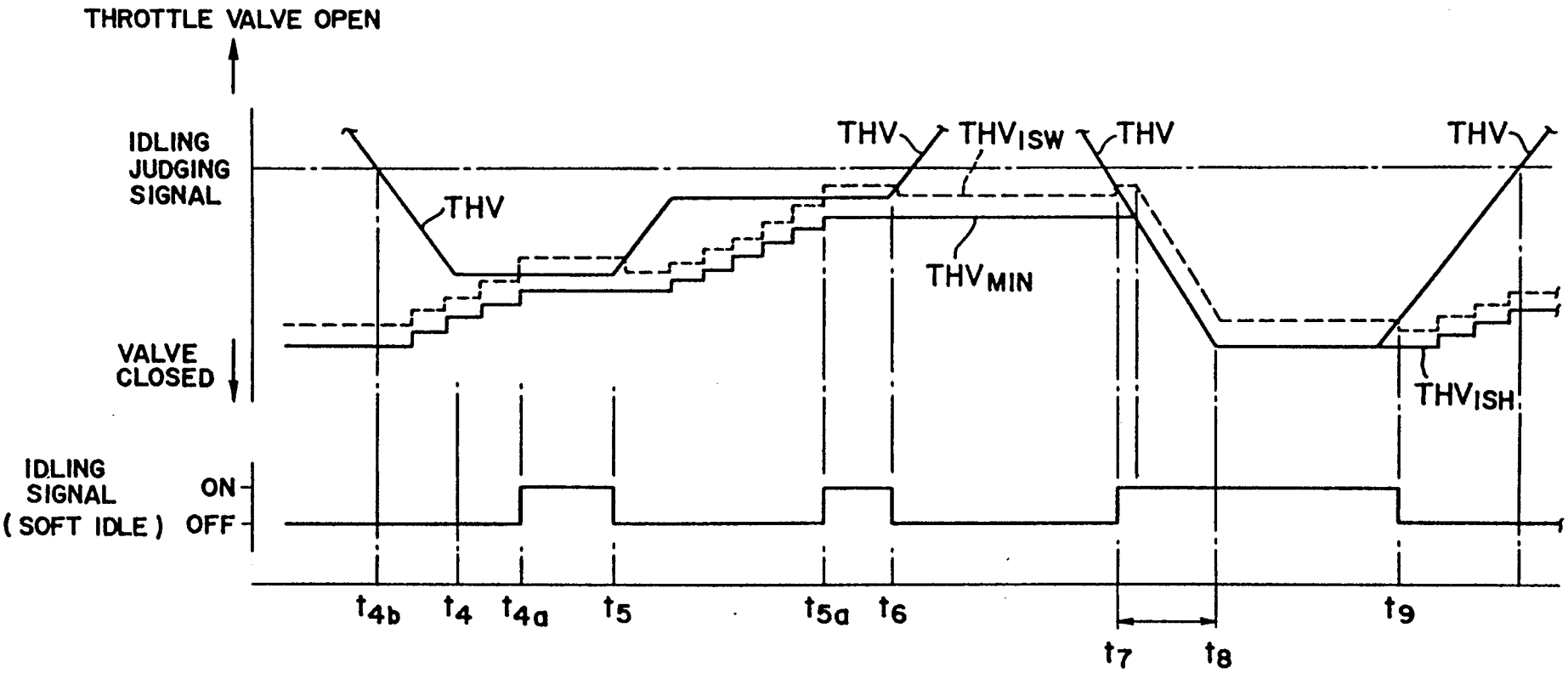
FIG. 7 is a timing chart showing characteristics Of the idling state in a cOnventiOnal cOntrol apparatus.

On the other hand, when the engine starts with depressing the accelerator pedal, the value THV of the sensor 9 is larger than the initially set reference value $THV_{ISW}$ ($THV > THV_{ISW}$), to therefore judge the non-idling state and to advance operation from the step ST25 to a step ST28. In the step ST28, the idling data $AI_{DATA}$ is set to "$AI_{DATA}=1$" and stored in the predetermined address of the RAM 23. In a step ST29, an non-idling state signal is output (lapse times t0 to t10 as shown in FIG. 6).

DURING IDLING OPERATION

When the operation of the engine 1 enters into the idling state after the engine starts with releasing the accelerator pedal, the updating procedure of the minimum value $THV_{MIN}$ after the first routine is performed as follows. First, the program of the steps ST10, ST11 and ST13 as mentioned above. At this time, the idling data $AI_{DATA}$ read in the step ST11 is set to "$AI_{DATA}=0$" (an idling-on state), to then advance from the step ST13 to the step ST14. In the step ST14, the value THV of the sensor 9 read in the step ST11 is compared with the minimum value $THV_{MIN}$ Operation advances to the step ST19 when the state is "$THV \leqq THV_{MIN}$". On the contrary, operation advances to the step ST15 when "$THV < THV_{MIN}$". In the step ST19, the counter value $T_{COUNT}$ is clarified to end the program (the lapsed time t1 and t2 in FIG. 5). The determination procedure for the idling state advances from the steps ST20 and ST21 to the step ST22. Therefore, as the idling data $AI_{DATA}$ are set to "$AI_{DATA}=0$" in the previous routine, the operation advances from the step ST22 to a step ST24.

In the step ST24, the reference value $THV_{ISW}$ is calculated by the following equation (1) in dependency on the minimum value $THV_{MIN}$ read out in the step ST21 and the increase compensation value $THV_D$:

$$THV_{ISW}=THV_{MIN}+THV_D+A+B \ldots \quad (1),$$

where symbol A denotes the first off-set value and symbol B the second offset value.

In the above equation, the increase compensation value $THV_D$ is "$THV_D=\phi$" which is set in the step ST2 in the case that the engine starts in an acceleration pedal release state.

In the step ST25, the reference value $THV_{ISW}$ calculated by the equation (1) is compared with the value THV outputted from the throttle sensor 9 and read in the step ST20.

At this time, the idling state is determined because the value THV is less than the reference value $THV_{ISW}$ ($THV \leqq THV_{ISW}$), which is set by adding the first and second offset values A and B and the increase compensation value $THV_D$ with the minimum value $THV_{MIN}$ stored in the RAM 23. Then, the operation advances from the step ST25 to the step ST26, the idling data $AI_{DATA}$ is set to "$AI_{DATA}=0$" and stored in the predetermined address in the RAM 23. Then, operation advances to the step ST27, and the idling state signal i outputted (refer to the lapsed times t1 and t2 in FIG. 5).

The RAM 23 stores the first and second offset values A and B shown in the equation (1), which have been already obtained by the experiment or the like.

Even if the minimum value $THV_{MIN}$ is used as it is as the reference value $THV_{ISW}$ without adding the offset values A and B, the non-idling state is erroneously determined in spite of the throttle valve fully closed when the value THV of the sensor 9 becomes larger than the minimum value $THV_{MIN}$ for one bit (the minimum resolution) according to the drift and so on. However, by using the reference value $THV_{ISW}$ which is offset by adding an offset term "A +B" with the minimum value $THV_{MIN}$, even if the sensor output value THV is larger than the minimum value $THV_{MIN}$ for one bit at the fully closed state of the throttle valve, the idling state is accurately determined.

By the experiment, it is desired that the first offset value A is 2 or 3 bit (10 to 15 mv) and the second offset value B is 1 or 2 bit (5 to 10 mv).

In the case where operation moves in the idling state by releasing the accelerator pedal after the engine starts in the off-state of the idle switch 10 by depressing the accelerator pedal, the operation is set forth as follow.

In an updating procedure of the minimum value $THV_{MIN}$ at this time, the program advances from the step ST10 to the step ST12 as described above because the idle switch 10 is still in the off-state from the lapsed time t100 to time t101 of FIG. 6. Namely, the increase compensation value $THV_D$ is set to the "$THV_D=\phi$" to end the program through the step ST19.

Accordingly, the minimum value $THV_{MIN}$ maintains the initial state of the step ST1 ($THV_{MIN}=THV_{INI}$)

The operation advances from the step ST10 to the step ST11 when the idle switch 10 is turned on, in order to read out the sensor value THV and the idling data $AI_{DATA}$ from the RAM 23, and to advance to the step ST13. At this time, since the idling data $AI_{DATA}$ is set to "$AI_{DATA}=1$" (in the non-idling state) by the previous procedure, the operation advaces to a step ST16. In the step ST16, the counted value $T_{COUNT}$ of the counter is increased as "$T_{COUNT} \leftarrow T_{COUNT}+1$"

In a step ST17, the counted value $T_{COUNT}$ in the step ST16 is compared with the set time TIME (such as 1 sec). The operation ends in the case of "$T_{COUNT}<TIME$", while the operation advances to step ST18 in the case of "$T_{COUNT} \geqq TIME$". In the step ST18, the increase compensation value $THV_D$ stored in the RAM 23 is updated by adding a set value $THV_s$ (such as 1 bit 5mv) thereto ($THV_D \leftarrow THV_D+THV_s$) In the step ST19, the counted value $T_{COUNT}$ of the counter is clarified to end the program (the lapsed time t101 to t102 of FIG. 6).

At the lapsed time t102, namely, at the point where the sensor value THV is on or less than the reference value $THV_{ISW}$, since the idling data $AI_{DATA}$ is set to "$AI_{DATA}=0$" (the steps ST25 to ST27), the operation advances from the step ST10 through the steps ST11 and ST12 to the step ST14.

Since the sensor value THV is still on or larger than the minimum value $THV_{MIN}$ stored in the RAM 23 ($THV \leqq THV_{MIN}$) from the time t102 to the time t103, the operation advances from the step ST14 to the step ST19 to end the program. Accordingly, the minimum value $THV_{MIN}$ is not updated.

After the lapsed time t103, since the sensor value THV becomes smaller than the minimum value $THV_{MIN}$ ($THV<THV_{MIN}$), the operation advances to the step ST15 through the steps ST11, ST13 and ST14. Namely, the minimum value $THV_{MIN}$ stored in the RAM 23 is updated by the sensor value THV which is read out in the step ST11, to end the program through the step ST19.

On the other hand, the idling state discrimination procedure flows through the steps ST20, ST21, ST22 and ST23 because the idling data $AI_{DATA}$ is set to "$AI_{DATA}=1$" in the previous routine. The reference value $THV_{ISW}$ is calculated by the following equation (2) in dependency on the minimum value $THV_{MIN}$, the increase compensation value $THV_D$ read out in the step ST21 and the first offset value;

$$THV_{ISW}=THV_{MIN}+THV_D+A \ldots (2).$$

In the step ST25, the reference value $THV_{ISW}$ calculated by the equation (2) is compared with the sensor value THV read out in the step ST20.

The idling state is not determined because the value THV is larger than the reference value $THV_{ISW}$ ($THV>THV_{ISW}$) until the lapsed time t102, and the operation advances from the step ST25 to the step ST28 in which the idling data $AI_{DATA}$ is set to "$AI_{DATA}=1$" to store in the RAM 23. Then, in the step ST29, the non-idling state signal is outputted.

The idling state is determined at the lapsed time t102 because of "$THV \leqq THV_{ISW}$", and the operation advances from the step ST25 to the step ST26. In the step ST26, the idling data $AI_{DATA}$ is updated to "$AI_{DATA}=0$". In the step ST27, the idling state signal is outputted.

Furthermore, in succeeding routines (during the time from t102 to the time t2 as shown in FIG.6), since the idling data $AI_{DATA}$ is set to "$AI_{DATA}=0$", operation advances from the step ST22 to the step ST24. In the step ST24, the reference value $THV_{ISW}$ is set by the equation (1) as represented above, the operation advances to the step ST27 through the steps ST25 and ST26, to output the idling state signal.

After the value THV of the sensor 9 is lowered under the reference value $THV_{ISW}$ calculated upon the equation (2), the reference value $THV_{ISW}$ is calculated on the basis of the equation (1), so as to be increased by the second offset value B. Therefore, it is possible to prevent the system from hunting such that the determination of the idling state changes alternately.

AT STARTING AND ACCELERATING THE VEHICLE

After starting and accelerating the vehicle, that is, after the lapsed time t2 in the time charts as shown in FIGS. 5 and 6, the output values THV of the throttle sensor 9 are assumed to change in the same manner. Accordingly, the description will be done in accordance with the time chart shown in FIG. 5.

The output value THV of the throttle sensor 9 increases gradually with the increase of the opening degree of the throttle valve 5 when the accelerator pedal is depressed to start and accelerate the vehicle from the idling state.

In the updating procedure of the minimum value $THV_{MIN}$, the output value THV of the sensor 9 is on or under the reference value $THV_{ISW}$($THV \leqq THV_{ISW}$) during the times t2 to t3 in FIG. 5. As the idling data $AI_{DATA}$ stored in the RAM 23 is set to "$AI_{DATA}=0$". (the idling state), operation advances from the step ST10 through the steps ST11 and ST13 to the step ST14.

At this time, since the output value THV is gradually increases, the value THV is on or over the minimum value stored in the RAM 23 ($THV > THV_{ISW}$), to therefore end the program from the step ST14 to the step ST19. Accordingly, the minimum value $THV_{MIN}$ is discontinued to be updated.

During the time from t3 to t5 in FIG. 5, since the value THV is over the reference value $THV_{ISW}$ ($THV > THV_{ISW}$) and the idling data $AI_{DATA}$ is set to "$AI_{DATA}=1$" (the non-idling state), the operation advances from the step ST13 to the step ST16, to increase the counted value $T_{COUNT}$ of the counter. In the step ST17, the increased counted value $T_{COUNT}$ of the step ST16 is compared with the set time TIME. When "$T_{COUNT} < TIME$", the program ends, and when "$T_{COUNT} \geqq TIME$", operation advances to the step ST18.

In the step ST18, the increase compensation value $THV_D$ is updated by adding the set value $THV_s$ to the previous value $THV_D$ stotred in the RAM 23 ($THV_D \leftarrow THV_D + THV_s$). In the step ST19, the program ends after the counted value $T_{COUNT}$ is clarified (time from t3 to t5 in FIG. 5).

At the starting and accelerating, the operation advances from the step ST10 to the step ST12 when the opening degree of the throttle valve 5 incrases and reaches to the set degree which the idle switch 10 is turned off, the increase compensation value $THV_D$ is clarified ($THV_D \leftarrow \phi$). Then, in the step ST19, the counted value $T_{COUNT}$ of the counter is clarified to end the program.

On the other hand, the idling state determination procedure is executed as follows. During the time from t2 to t3 as shown in FIG. 5, since the idling data $AI_{DATA}$ is set to "$AI_{DATA}=0$" in the previous routine, the operation advances from the step ST22 to the step ST24. Namely, the reference value $THV_{ISW}$ is set by the aforementioned equation (1) in accordance with the minimum value $THV_{MIN}$ read out in the step ST21 and the increase compensation value $THV_D$. The operation advances to the step ST25.

During the time from t2 to t3, the idling state is determined because the output value THV is on or under the reference value $THV_{ISW}$ set in step ST24 ($THV \leqq THV_{ISW}$), so that the operation advances from the step ST25 to the step ST26. In the step ST26, the idling data $AI_{DATA}$ is set to "$AI_{DATA}=0$" and stores it in the predetermined address of the RAM 23, to output the idling state signal in the step ST27.

At the lapsed time t3 in FIG. 5, the value THV is "$THV > THV_{ISW}$" and the non-idling state is determined. The operation advances from the step ST25 to the step ST28. In the step ST28, the idling data $AI_{DATA}$ is updated to "$AI_{DATA}=1$". In the step ST29, the system outputs the non-idling state signal.

During the time from t3 to t5 in FIG. 5, as the idle switch 10 is turned on and the idling data $AI_{DATA}$ is set to "$AI_{DATA}=1$" (the non-idling state), the increase compensation value $THV_D$ is increased and updated every set time TIME by the set value $THV_s$ in the step ST18. Accordingly, the reference value $THV_{ISW}$ set in the step ST23 increases for the increase compensation value $THV_D$ updated in the step ST18 at every set time TIME.

Next, at the lapsed time t5, i.e., when the idling switch 10 is turned off, the increase compensation value $THV_D$ is cleared in the step ST23. Accordingly, the reference value $THV_{ISW}$ set in the step ST23 is defined by a value of the minimum value $THV_{MIN}$ and the first offset value A until the idle switch 10 is turned on again (the lapsed time t6).

When the relationship between the output value THV of the throttle sensor 9 and the reference $THV_{ISW}$ changes from "$THV \leqq THV_{ISW}$" to "$THV > THV_{ISW}$", an offset amount corresponding to the minimum value $THV_{MIN}$ decreases for the second offset value B, so that the determination of the idling state is prevented from the hunting.

DECELERATING THE VEHICLE

On the other hand, when the accelerator pedal is released for the deceleration of the vehicle, the sensor output value THV decreases in a direction of the minimum value $THV_{MIN}$, changing the idle switch 10 from being turned off to on at the set opening degree $\theta$·.

The operation for updating the minmum value $THV_{MIN}$ advances from the step ST10 to the step ST11 because the idle switch 10 is turned on. Then, the output value THV is read out and the idling data $AI_{DATA}$ is read out from the predetermined address of the RAM 23. The operation advances to the step ST13.

At this time, since the idling data $AI_{DATA}$ is set to "$AI_{DATA}=1$" (the non-idling state) in the previous idling state detemination procedure, the operation advances from the step ST13 to the step ST16. In the step ST16, the counted value $T_{COUMT}$ of the counter increases.

Next, in the step ST17, the counted value $T_{COUNT}$ in the step ST16 is compared with the set time TIME. The program ends when "$T_{COUNT} < TIME$", and the operation advances to the step ST 18 when "$T_{COUNT}$24 TIME". Then, the increase compensation value $THV_D$ is updated by adding the set value $THV_s$ to the increase compensation value $THV_D$ stored in the predetermined address of the RAM 23 ($THV_D \leftarrow THV_D + THV_s$). In the step ST19, the counted value $T_{COUNT}$ of the counter is clarified to end the program (the time from t6 to t9 in FIG. 5).

On the other hand, the idling state determination procedure at this time advances from the step ST22 to the step ST23 because the idling data $AI_{DATA}$ is set to "$AI_{DATA}=1$" (the non-idling state). In the step ST23, the reference value $THV_{ISW}$ is set by the aforementioned equation (2) to advance to the step ST25.

During the time from t6 to t9 in FIG. 5, the non-idling state is determined because the sensor output value THV is over the reference value $THV_{ISW}$ ($THV > THV_{ISW}$), and the operation advances from the step ST25 to the step ST28. In the step ST28, the idling data $AI_{DATA}$ stored in the RAM 23 is set to "$AI_{DATA}=1$", and the non-idling signal is outputted in the step ST29.

As shown by the time from t8 to t10 in FIG. 5, the output value THV of the sensor 9 is assumed to become a value shifting to a direction of opening the throttle valve at the throttle valve 5 in dependency on the distortion of the throttle shaft 5a which connects the potentiometer of the throttle sensor 9, the distortion of the throttle shaft 5a by the negative pressure at the fully closed state of the throttle valve, and the drift of the value THV by the temperature change. The output value THV of the sensor 9 is higher than the reference value $THV_{ISW}$ despite the throttle valve being fully closed in actual, threreby making it impossible to detect the idling state.

Thererfore, the present invention updates the increase compensation value THVD stored in the RAM 23 by adding the the set value THVs at every set time TIME in the step ST18 through the steps ST13, ST16 and ST17 in the case of "$THV > THV_{ISW}$" when the idle switch 10 is in the ON-state. Accordingly, the reference value $THV_{ISW}$ which is set by adding the first offset value A to an additional value of the minimum value $THV_{MIN}$ and the increase compensation value THVD, is also increased in a direction of opening side of the throttle valve 5 for the set value $THV_s$ at every set time TIME. Then, at the lapsed time t9 in FIG. 5, as the reference value $THV_{ISW}$ is on or over the output value THV of the sensor 9, the idling state can be determined at the steps ST25, ST16 and ST27 of the idling state determination procedure even if the output value THV drifts in the fully closed state of the throttle valve 5.

The set time TIME and the set value $THV_s$ are obtained in advance by the experiment and stored in the ROM 22. For example, it is desired that the set time is set to "TIME = 1 sec", and the set value $THV_s = 1$ bit (5 mv)" with the consideration of the influence of the idling determination when the output value THV of the sensor 9 is in the ordinary state.

Furthermore, the first embodiment uses only the first offset value A when "$THV > THV_{ISW}$", and uses both first and second offset values A and B when "$THV \leqq THV_{ISW}$". Accordingly, the hysteresis is formed at interchanges between $THV > THV_{ISW}$ "and "$THV \leqq THV_{ISW}$", thereby making it possible to prevent the hunting of the determination of the idling state.

As the result, the idling determination of the present invention can be performed precisely in comparison with that only using the output signal of the switch 10, and it is possible to obtain the precise idling state signal corresponding to the throttle valve fully closed state.

AT STEADY RUNNING

Generally, the driver redepresses and maintains the accelerator pedal in a small depression degree for the steady running after the acceleration of the vehicle, so that the idling switch 10 is turned on (during the period from t10 to t14 of FIG. 5).

At this time, the idling data $AI_{DATA}$ is set to "$AI_{DATA}=0$" because of the idling state during the time from t8 to t10 of FIG. 5.

When the driver softly depresses the acceleration pedal and keeps a small opening degree of the throttle valve 5 for the steady running without making the idle switch 10 OFF state, the sensor value is "$THV > THV_{ISW}$" in the lapsed time t11 of FIG. 5, and the idling data $AI_{DATA}$ is set to "$AI_{DATA}=2$" (the non-idling state) in the step ST28 of the idling state determination procedure.

In the increase compensation value updating procedure, as the idling data $AI_{DATA}$ is set to "$AI_{DATA}=1$" in the previous routine, the operation advances from the step ST10 to the step ST16 through the steps ST11 and ST13 of FIG. 3B. After the counted value $T_{COUNT}$ increases in the step ST16, the increase compensation value $THV_D$ is updated by the set value $THV_s$ at every set time TIME in the step ST18.

When "$THV \leqq THV_{ISW}$" is determined in the step ST25 as shown in FIG. 4, the idling data $AI_{DATA}$ is set to $\phi$ "$AI_{DATA}=\phi$" in the step ST26. Accordingly, operation advances from the step ST13 to the step ST14 in FIG. 3B and the updating of the value $THV_D$ is discontinued (the time from t13 to t14 in FIG. 5).

When the throttle opening degree is over $\theta$ by depressing the accelerator pedal in the steady running, the idling switch 10 is determined to be turned off in the step ST10. In the step ST12, the increase compensation value $THV_D$ is clarified ($THV_D \leftarrow \phi$). After that, the reference value $THV_{ISW}$ set in the step ST23 of FIG. 4 becomes the additional value of the minimum value $THV_{MIN}$ and the first offset value A (the time from t16 to t17 of FIG. 5).

When the driver releases the accelerator pedal again to decelerate the vehicle, the idle switch 10 is determined to be turned on in step ST10 (at the lapsed time t17). The increase compensation value $THV_D$ is updated to increase at every set time TIME in the step ST16 and the following steps. However, since the increase compensation value $THV_D$ is clarified ($THV_D \leftarrow \phi$) before the lapsed time t17, the reference value set in the step ST23 of FIG. 4 is low, thereby preventing that the idling state is determined earlier.

As a result, it is possible to improve the controllability of an air-fuel ratio and an ignition timing at the begining of the coasting running of the vehicle, thereby obtaining good drivability.

As shown at the lapsed time t19 in FIG. 5, if the sensor output value THV becomes on or under the minimum value $THV_{MIN}$, the operation advances from the step ST14 to the step ST15. In the step ST15, the minimum value $THV_{MIN}$ is updated by the output value THV ($THV_{MIN} \leftarrow THV$).

On the other hand, the control unit 20 controls the air-fuel ratio, ignition timing and engine speed at the idling rate responsive to the idling state signal outputted from the determination system 30.

The idling or non-idling state is determined directly responsive to the signal outputted from the switch 10 when the switch 10 has not turned on at all after the control unit 20 has supplied the electric power, when the output value of the throttle sensor 9 is unstable or inaccurate, or when the unit 20 performs a self-diagnosis condition.

Though the first embodiment is described in the case of using a type of the throttle sensor of which decreases the output value as reducing the opening degree of the throttle valve, the present invention is limited to the above construction. For example, this invention may use the type of the throttle sensor of which increases the output value as reducing the opening degree of the throttle valve. In this case, a direction of a sign of inequality becomes opposite in the steps ST14 and ST24 of the FIGS. 3B and 4, respectively, and the system uses a maximum value instead of the minimum value.

Furthermore, though the first embodiment uses an idle switch which is turned off at the opening side of the set degree $\theta$·of the throttle valve and turned on the closed side of the degree $\theta$·, the present invention may use the switch which is turned off at the closed side and turned on at the opening side of the degree $\theta$·. In this case, the determination in the step ST10 is opposite.

Next, there will now be described in detail an engine idling control apparatus according to the second embodiment of the present invention with reference to FIGS. 8 to 10. The control apparatus is provided in the engine control system for the vehicle having the same construction in the first embodiment and has the same arrangement of the circuit as the first embodiment shown in FIG. 1.

Figure 8:
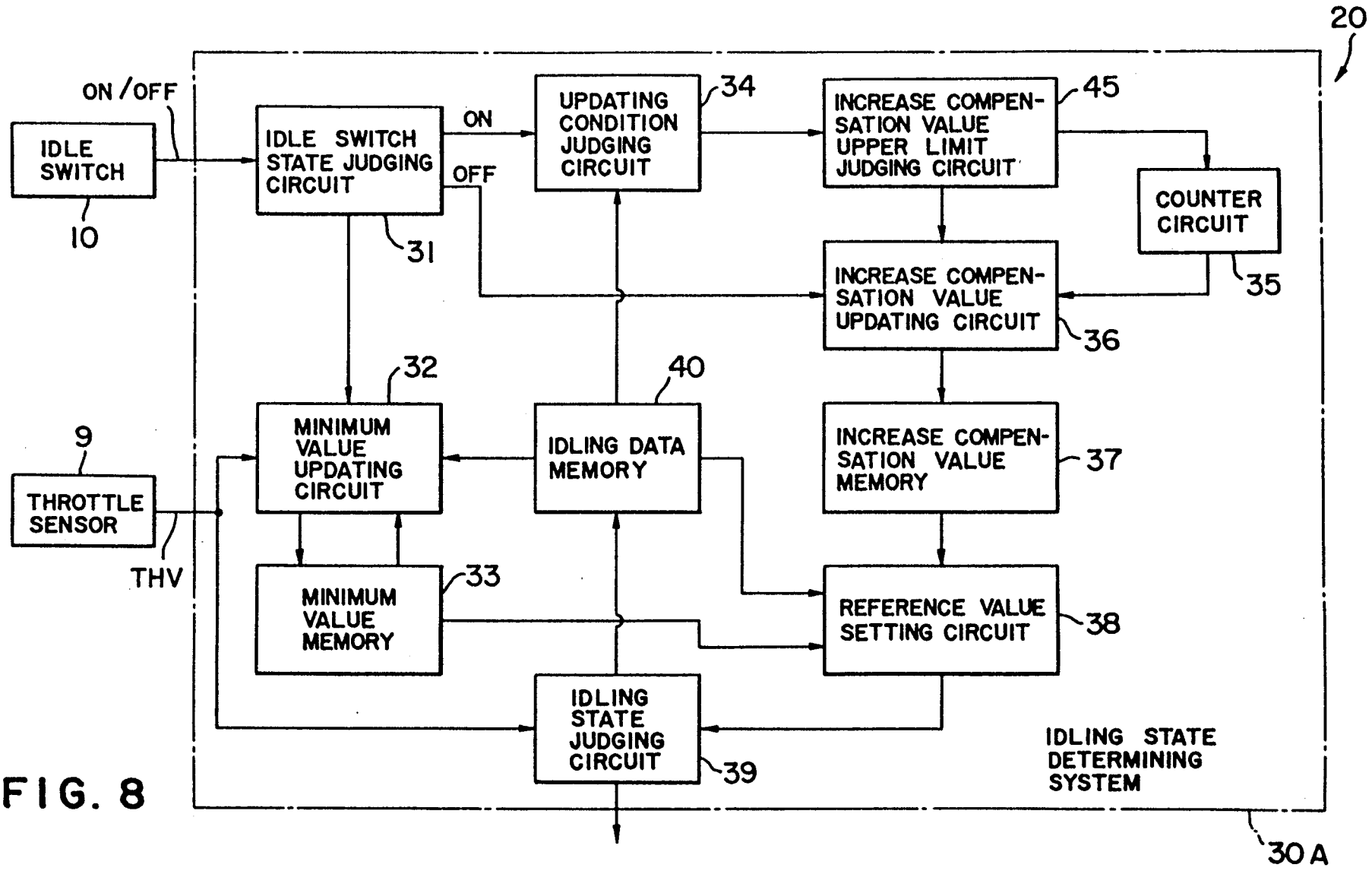
FIG. 8 is a functional block diagram showing an engine idling control apparatus according to a second embodiment of the present invention.

An idling state determining system 30A has a construction substantially same as that of the system 30, as shown in FIG. 8. Accordingly, the duplicate description will be omitted because components in FIGS. 2 and 8 having the same numerals each other operate in same manner.

The different construction between the systems 30A and 30 is that the system 30A has an upper limit judging circuit 45 for an increase compensation value. The circuit 45 outputs a trigger signal to a counter circuit 30 in dependency on a judged result of an updating condition judging circuit 34 for an increase compensation value and a stored value in an increase compensation value memory 37. Namely, the circuit 45 compares an increase compensation value $THV_D$ stored in the memory 37 with a preset upper limit value $THV_{LIMIT}$(for example, 7 bit:35 mv) when the updating condition judging circuit 34 determines that the updating condition is completed.

The circuit 45 outputs the trigger signal to the counter circuit 35 when the compensation value $THV_D$ is under the upper limit value $THV_{LIMIT}$($THV_D < THV_{LIMIT}$).

On the contrary, the circuit 45 outputs a hold signal to the circuit 35 and causes a value updating circuit 36 to fix the compensation value $THV_D$ at the limit value $THV_{LIMIT}$ ($THV_D \leftarrow THV_{LIMIT}$) when the value $THV_D$ is on or over $THV_{LIMIT}$($THV_D \geqq THV_{LIMIT}$).

The counter circuit 35 increases the counted value responsive to the trigger signal from the judging circuit 45 and compares the counted value $T_{COUNT}$ with a preset setting time TIME (for example, TIME=1 sec). the counter circuit 35 outputs the trigger signal to the updating circuit 36 when "$T_{COUNT} \geqq$ TIME", namely, when the updating condition continues during a set time. On the other hand, the circuit 35 resets the counted value $T_{COUNT}T_{COUNT} \leftarrow \phi$) when the judging circuit 45 outputs the hold signal.

As the updating circuit 36 and the memory 40 have the same operation of those in the system 30 of the first embodiment, the duplicate description will be omitted.

Figure 9A:
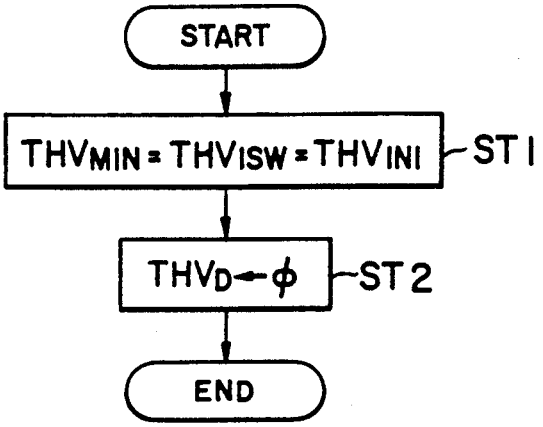
FIGS. 9A and 9B are flow charts showing updating procedures of the stored minimum value and the increase compensation value, respectively, in the control apparatus according to the second embodiment of this invention.
Figure 9B:
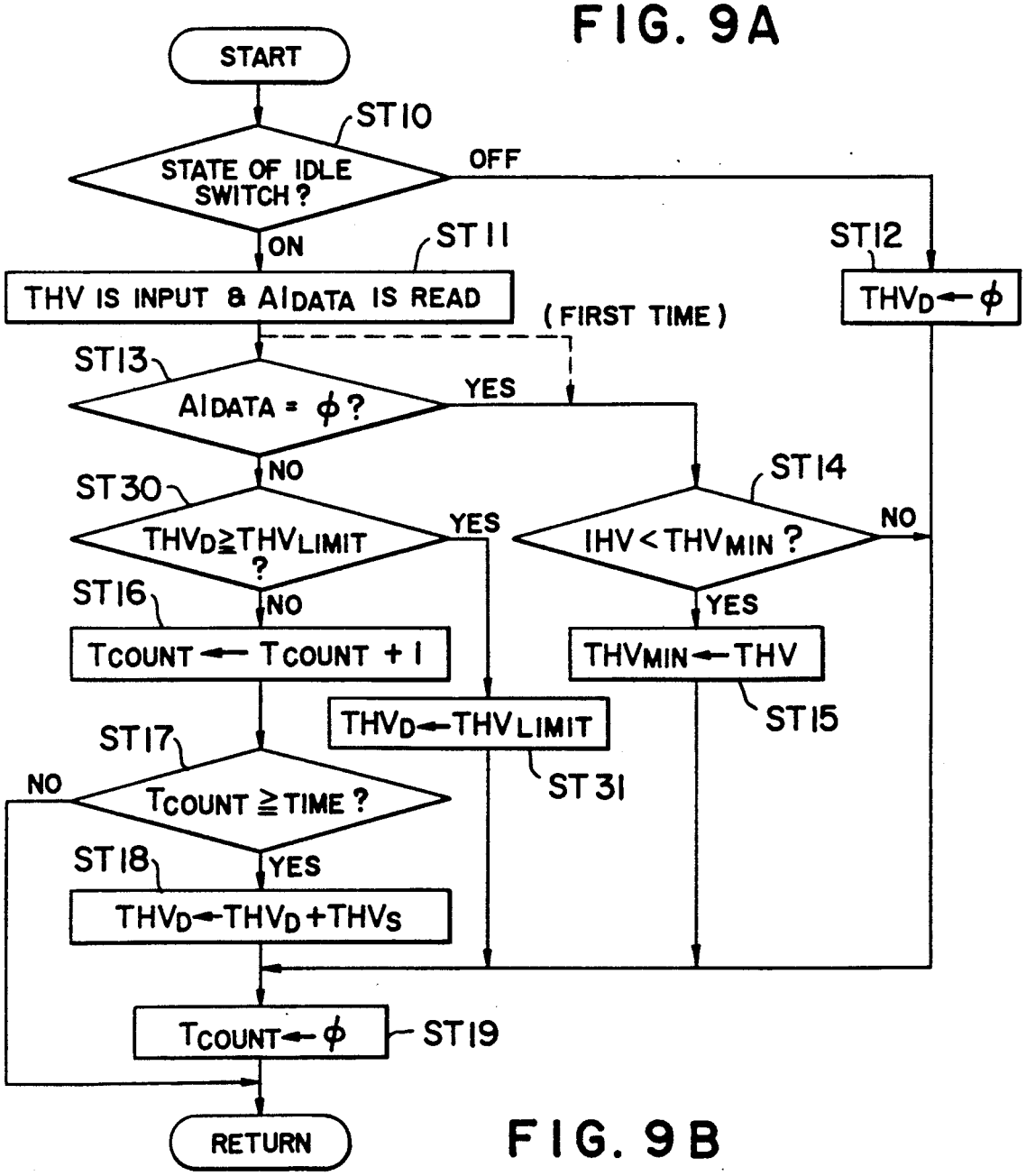
Figure 10:
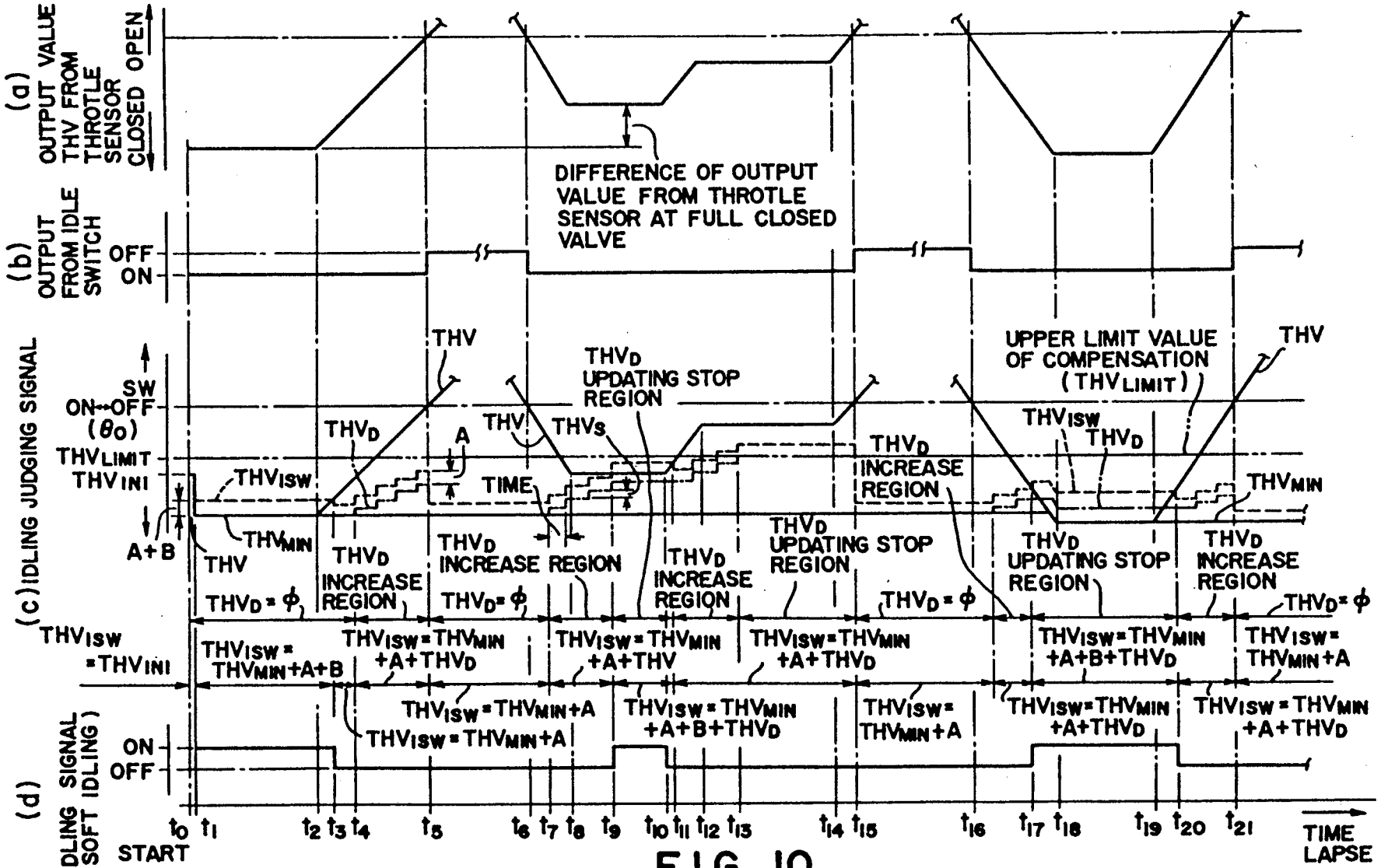
FIG. 10 is a timing chart showing (a) an output value from a throttle sensor, (b) an idle switch output, (c) an idling judging signal, and (d) a soft-idling state, respectively.

Next, there will be described the operation of the system 30A having the above construction with reference to flow charts as shown in FIGS. 9A to 10.

As FIG. 9A represents a main routine of the operation and has contents on FIG. 3, the duplicate description is omitted.

After starting the main routine, a reference value $THV_{ISW}$ for judging the idling state is initialized by an initial value $THV_{INI}$. As the operation of updating the value $THV_D$ after the initializing is the substantially same as that of the first embodiment, the description of the steps ST10 to ST19 as shown in FIG. 3B can be referred Accordingly, steps ST30 and ST31 are mainly described as the most characteristic steps of the second embodiment.

As shown in FIG. 9B, after the idling data $AI_{DATA}$ is read out in the step ST11, the idling dats $AI_{DATA}$ is determined as to whether "$AI_{DATA}=\phi$" is or not. The determination is performed by the circuit 39. The operation advances to the step ST19 through the steps ST14 and ST15 when "$AI_{DATA}=\phi$" in the same manner as shown in flow charts of FIG. 3B. When "$AI_{DATA}=1$", namely, out of the idling state, the operation advances to the step ST30.

In the step ST30, the increase compensation value $THV_D$ stored in the RAM 23 is compared with the limit value $THV_{LIMIT}$ (for, example, 7 bit:35 mv) which is preset. The operation advances to the step ST16 when the compensation value $THV_D$ is under the limit value $THV_{LIMIT}$ ($THV_D < THV_{LIMIT}$), while the operation advances to the step ST31 when the compensation value $THV_D$ is on or over the limit value $THV_{LIMIT}$ ($THV_D \geqq THV_{LIMIT}$).

By the way, the idle switch 10 is turned off ($AI_{DATA}=1$) when the engine starts with pressing the accelerator pedal. Accordingly, as the compensation value $THV_D$ is set to phi ($THV_D=\phi$)in the first routine in which the idle switch 10 is turned on, the operation advances from the step ST16 to the step ST17.

In the step ST17, the counter circuit 35 increases the counted value $T_{COUNT}$ ($T_{COUNT} \leftarrow T_{COUNT}+1$).

As the operation after step ST17 is the same as that of the first embodiment, duplicate description is omitted.

Next, the operation at the starting and accelerating the vehicle, is the same as that of the first embodiment without steps ST30 and ST31, whereby limiting the upper value of the compensation $THV_D$.

Namely, during the time t3 to t5 in FIG. 10, as the sensor output value THV is over the reference value $THV_{ISW}$($THV > THV_{ISW}$) and the idling data $AI_{DATA}$ is set to "$AI_{DATA}=1$" (the non-idling state), the operation advances from the step ST13 tot he step ST30. In the step ST30, the increase compensation value $THV_D$ is compared with the upper limit value $THV_{LIMIT}$ (for example, 7 bit:35 mv). The operation advances to the step ST16 when the value $THV_D$ is under the limit value ($THV_D < THV_{LIMIT}$), and to the step ST31 when the value is on or over the limit value ($THV_D \geqq THV_{LIMIT}$).

The operation after the step ST16 is the substantially same as the first embodiment, and therefore duplicate description is omitted.

As the operation at decelerating the vehicle speed is the same as that of the first embodiment, only different points are described. As the idling data $AI_{DATA}$ is set to "$AI_{DATA}=1$" in the previous procedure for determining the idling state (the non-idling state), the operation advances from the step ST13 to the step ST30. In the step ST30, the increase compensation value $THV_D$ is compared with the preset upper limit value $THV_{LIMIT}$ (for example, 7 bit 35 mv). The operation advances to the step ST16 when the compensation value $THV_D$ is under the limit value $THV_{LIMIT}$ ($THV_D < THV_{LIMIT}$), and to the step ST31 when the value $THV_D$ is on or over the limit value $THV_{LIMIT}$ ($THV_D \geqq THV_{LIMIT}$).

The updating procedure of the increase compensation value at the steady running of the vehicle is also that of the same as the first embodiment such as the steps ST10, ST11 and ST13. And the steps ST16 to ST19 are the same as that of the first embodiment after "$THV_D < THV_{LIMIT}$" is determined in the step ST30. In the step ST31, the value $THV_D$ is fixed to the limit value $THV_{LIMIT}$ ($THV_D \leftarrow THV_{LIMIT}$).

As a result, the system 30A stops increasing the reference value $THV_{ISW}$ for determining the idling state when the vehicle is running in the steady condition with a small opening degree of the throttle valve under turning on the idle switch 10, thereby preventing the erroneous determination of the idling state. Accordingly, it is possible to improve the controllability of an air-fuel ratio, an ignition timing, and driving characteristics (the time from t13 to t14).

As described in detail, the present invention has the excellent effects that the idling state is determined accurately, and it is possible to obtain a stable power performance of the engine even if the idle switch is turned on under the steady running of the vehicle. Furthermore, this invention has the effect to improve the driveability and controllability of the air-fuel ratio and the ignition timing because the idling state is not determined earlier when the operation of the vehicle changes in the coasting running.

While the presently preferred embodiments of the present invention have been shown and described, it is to be understood that these disclosures are for the purpose of illustration and that various changes and modification may be without departing from the scope of the invention as set forth in the appended claims.

What is claimed is:

1. An engine idling control apparatus having a throttle position sensor for detecting an opening degree of the throttle valve, and an idle switch for changing a state thereof at a predetermined throttle opening degree near a fully closed state of the throttle valve; comprising means for judging the state of the idle switch responsive to output from said idle switch;

means for updating a minimum value of output values from said throttle position sensor;

means for updating an increase compensation value to increase when said idle switch state judging means judges closed state of said idle switch, and for updating said increase compensation value to initialize when said idle switch state judging means judges open state of said idle switch;

means for setting a references value to judge an idling state by adding said increase compensation value from said increase compensation value updating means and a predetermined offset value to said minimum value from said minimum value updating means; and means for judging said idling state by comparing said reference value which is set by said reference value setting means with said output value from said throttle position sensor.

2. The apparatus according to claim 1, further comprising means for judging an upper limit of said increase compensation value when said increase compensation value resides more than a preset upper limit value, so as to fix said increase compensation value to said preset upper limit value.

3. The apparatus according to claim 1, further comprising means for counting a time when said idle switch keeps the ON state; and said increase compensation value updating means for updating when said time counted by said counting means reaches a set time.

4. The apparatus according to claim 1, wherein said reference value setting means sets the reference value by further adding a second predetermined offset value when said idling state judging means judges said idling state.

* * * * *